United States Patent [19]

Dison et al.

[11] 4,388,767

[45] Jun. 21, 1983

[54] PROCESS AND APPARATUS FOR STORING PAINT BRUSHES AND THE LIKE

[76] Inventors: Gordon F. Dison, "Crae", Royleen Dr., Frodsham, Cheshire; Henry B. Dison, 16, Crescent Dr., Helsby, Cheshire, both of England

[21] Appl. No.: 243,700

[22] Filed: Mar. 16, 1981

[51] Int. Cl.[3] ..... B08B 5/00

[52] U.S. Cl. ..... 34/78; 34/202; 15/248 R; 134/11; 134/38; 252/DIG. 8

[58] Field of Search ..... 134/11, 38, 31; 252/DIG. 8; 211/65, 66; 248/110, 112, 113; 15/248 R, 268; 34/202, 75, 78

[56] References Cited

U.S. PATENT DOCUMENTS

| | | | |
|---|---|---|---|
| 1,058,808 | 4/1913 | Thilges | 237/78 X |
| 1,644,737 | 10/1927 | Maker | 237/78 B |
| 2,566,650 | 9/1951 | Anderson | 211/65 |
| 2,945,251 | 7/1960 | Eichner | 211/65 |
| 3,156,364 | 11/1964 | Wolcott | 211/65 |
| 4,231,804 | 11/1980 | Petterson et al. | 134/11 |

*Primary Examiner*—Larry I. Schwartz

*Attorney, Agent, or Firm*—Stevens, Davis, Miller & Mosher

[57] ABSTRACT

There is disclosed a process and apparatus for the at least substantial prevention of hardening of paint brushes and the like which harden by an oxidation/-polymerisation mechanism. The paint brush, or the paint applying portion thereof, is suspended within a housing, the housing being provided with a cover. The housing contains therein, or is supplied therewith, an effective amount of at least one antioxidant or a composition containing at least one antioxidant, the vapour of which is effective in at least substantially preventing the stated hardening of the paint on said paint brush.

6 Claims, 9 Drawing Figures

PROCESS AND APPARATUS FOR STORING PAINT BRUSHES AND THE LIKE

BACKGROUND OF THE INVENTION

The present invention relates to a process and apparatus for storing wet paint brushes and related items for paints, varnishes, sealers and coatings which harden by an oxidation/polymerisation mechanism, within a chemical vapour to maintain same in a wet condition and thereby be suitable for immediate re-use.

A problem which has heretofore been experienced with paint brushes and related items for paints, varnishes, sealers and coatings which harden by oxidation/polymerisation, is the necessity of either having to clean such brushes and related items or alternatively immersion them in a suitable liquid at the end of a painting session, in order to prevent hardening of the paint applying portion thereof.

The cleaning of brushes and related items can be a time-consuming operation and in the case of painting contractors, the time spent on cleaning brushes and related items can be of the order of one hour per week per man.

A disadvantage of utilising the previously known arrangement of immersing paint brushes or related items in a liquid, generally a container at least partly filled with water, or a solvent, is that the liquid has to be dried off before the brush or related item can be re-used. Moreover, if the brush or related item is left for some time in the container, then the liquid contained therein may evaporate thereby leaving the bristles of the brush or the paint applying portion of related items, to harden.

A particular problem when leaving a brush in water is that the metal ferrule of the brush can rust, as well as the nails or rivets utilised therein, and accordingly the brush can eventually be rendered useless.

Furthermore, an additional disadvantage is that brushes stored in such manner usually rest on their bristles which will tend to cause same to become permanently bent.

It is an object of the present invention to provide a process and apparatus whereby the disadvantages mentioned above are at least minimised and enables a paint brush or related item to be maintained in a wet condition for immediate re-use.

As used throughout the specification, the term "paint brushes and related items" relates to all forms of paint applying means, such as paint pads, paint rollers and paint spray equipment etc.

SUMMARY OF THE INVENTION

According to the present invention there is provided a process for the prevention, or at least substantial prevention, of hardening of paint brushes and related items for paint, varnishes, sealers and coatings which harden by an oxidation/polymerisation mechanism, comprising suspending said paint brush or related item or paint applying portions thereof within a housing therefor, providing a cover for the housing, and said housing containing therein or being supplied with an effective amount of at least one antioxidant or a composition containing at least one antioxidant the vapour of which is effective in preventing, or at least substantially preventing, the stated hardening of the paint on said paint brush or related items.

Also in accordance with the present invention there is provided an apparatus for the prevention, or at least substantial prevention, of hardening of paint brushes and related items for paints, varnishes, sealers and coatings which harden by an oxidation/polymerisation mechanism, comprising a housing for said paint brushes and related items, means for suspending one or more of said paint brushes and related items or paint applying portions thereof within said housing, a cover being provided for said housing and means, comprising suitable chamicals for providing one or more antioxidants or a composition containing one or more antioxidants in said housing to provide a vapour system which prevents, or at least substantially prevents, the stated hardening of the paint on said paint brushes and related items, or paint applying portions thereof when suspended within said housing.

DESCRIPTION OF PREFERRED EMBODIMENTS

The portion of the composition which blocks the oxidation/polymerisation hardening mechanism of the paint is a vaporizable antioxidant effective in its vapour phase such as a butyraldoxime and, more particularly preferably, methyl ethyl ketoxime, although of course any other suitable antioxidant may be utilised. One or more suitable antioxidants may be used in combination with one another.

The antioxidant(s) may be utilised on its own but is less effective than the composition in maintaining the paint in a soft and wet state.

The portion of the composition which supplies suitable solvent vapours which assist the paint to remain in a soft and wet condition, preferably comprise one or more of dipentene, an alcohol, particularly n-butanol and white spirit, although any other suitable solvent or solvents may be used. Terpenes, such as dipentene, are also useful for blocking the oxidation/polymerisation hardening mechanism of the paint due to the blanketing effect of their vapours, but are more usefully employed as part of a composition.

The antioxidant(s) and the one or more solvents associated therewith are generally completely miscible with one another and simple agitation is generally the only manufacturing process required.

Preferred compositions utilisable in the process and apparatus of the present invention are as follows:

| Constituent | Preferred Range | Particularly preferred value |
|---|---|---|
| Methyl ethyl ketoxime | 10–90% by volume | 25% by volume |
| Dipentene | up to 60% by volume | 10% by volume |
| n-Butanol | up to 20% by volume | 5% by volume |
| White Spirit | up to 90% by volume | 60% by volume |

In accordance with an embodiment of the apparatus of the present invention, the housing is provided with a plurality of devices for suspending the brushes and related items therein together with means for providing the vaporisable antioxidant(s) or composition containing such antioxidant(s) in said housing. The vaporisable antioxidant(s) or composition containing such antioxidant(s) is preferably provided in a suitable container having means to ensure an adequate vaporising area to be established within the housing in which the paint brushes and related items are suspended, as well as ensuring release of said vapour in a uniform manner. Sufficient vaporising area is required in order to ensure restoration as quickly as possible of the vapour losses which occur when the cover of the housing is taken off to enable paint brushes and related items to be taken from or inserted into said housing.

The container for the antioxidant(s) or composition containing such antioxidant(s) preferably comprises a suitable glass or plastics bottle having a restricted opening and a vaporising wick of suitable surface area inserted therein. The vaporising wick arrangement is preferably constituted by the use of suitable absorbent paper of fluted design.

The utilisation of such vaporising system enables the level of the vaporisable composition to be easily monitored, provides a balanced emission of the vapours of the components of such composition and, moreover, provides a vaporising surface which can be conveniently located within the housing.

In an alternative embodiment of the invention, the reservoir for the antioxidant(s) or composition containing such antioxidant(s) can be formed integrally with the cover or the side of the container.

Alternatively the antioxidant(s) or composition containing such antioxidant(s) may be located in or on a vaporising pad which is attached, preferably magnetically to the underside of the cover or the side of the container.

A further aspect is that vaporisation can take place directly from the surface of the liquid, in which case liquid vaporisable composition will either cover at least a portion of the base of the housing or will be contained in a separate container of sufficient surface area.

In accordance with a further preferred embodiment of the present invention, the means for suspending the paint brushes and related items will be such as to enable vapour to circulate completely around the bristles of the brushes or the paint applying portions of the related items.

In connection with paint brushes, it is desirable to use a spring clip type arrangement into which the neck of the brush is placed and to provide a flange extending from the side wall of the housing against which flange the metal ferrule portion of the brush will contact, thereby enabling the brush to be suspended within the housing and also be spaced from the side walls thereof. The spring clip arrangements may be replaced by appropriate plastics material means. Alternatively, a suitable magnet may be utilised to support the brush by attraction of the metal ferrule.

Furthermore, the housing is preferably supplied with means for enabling a plurality of paint brushes to be inserted into and suspended within the housing, which means may be provided with an arrangement to vary the distance between adjacent spring clip arrangements so as to accommodate varying sizes of paint brushes.

The housing may be made of any suitable form of metal, glass or plastics material and if of opaque nature may desirably be provided with a window arrangement in a wall portion thereof in the region in which the container for the vaporisable composition is located within the housing, to enable a ready check to be made as to the level of the liquid chemical composition in such container.

In view of the fact that the antioxidant vapour is heavier than air, there is no need for a hermetically sealed cover. However, if desired, it would be possible in accordance with the invention to provide a hermetic seal arrangement in the region of the cover of the container to prevent any vapour escaping.

The vaporisable composition utilised in the present invention may be located in a reservoir which is outside of, but connected to, the housing, the housing for the paint brushes and related items. Moreover, in place of the spring clip arrangement which is preferably utilised, it is also in accordance with the invention to provide any form of means which will enable a paint brush or related item to be suspended within the container. For instance, a wire support frame can be utilised, or a suitable socket into which the handle of a paint brush or related item can be secured, and it will be clear that many alternative forms may also be used.

In a preferred arrangement the volume of the container and the size of the wick are selected so as to ensure that the container is provided with a vapour system of adequate vaporising area, the vapour being released in a uniform manner.

The apparatus of the present invention will be further illustrated, by way of example, with reference to the accompanying drawings, in which.

Figure 1:
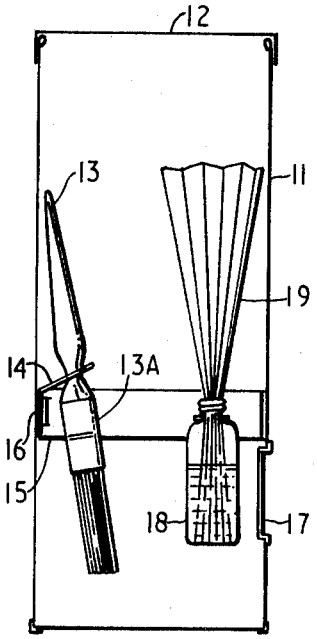
FIG. 1 is a side elevation, with a side wall cut away, of an apparatus in accordance with the present invention.
Figure 2:
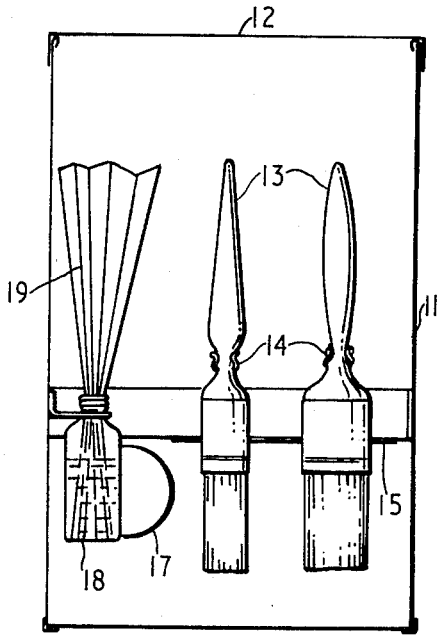
FIG. 2 is a front elevation, with the front wall cut away, of the apparatus illustrated in FIG. 1.
Figure 3:
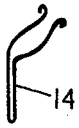
FIG. 3 is a view of a spring clip arrangement which may be utilised in the apparatus of the present invention.

As illustrated in FIGS. 1 and 2, an apparatus in accordance with the invention comprises a housing 11 having a cover 12 therefor. As mentioned previously, it is not necessary for the cover 12 to be hermetically sealed to the housing 11 in view of the fact that the antioxidant vapour utilised in the apparatus is heavier than air.

Paint brushes 13 are suspended within housing 11 utilising spring clip arrangements 14. Each spring clip arrangement 14 is so constructed as to ensure that when a paint brush 13 is suspended in the housing 11 it is possible for vapour to circulate completely around the bristles thereof.

The neck of each paint brush 13 is placed within a respective spring clip arrangement 14 and a flange 15 is provided on the side wall of the housing 11, against which flange the metal ferrule portion 13A of the paint brush 13 will contact. Such location of each paint brush 13 enables same to be suspended within the housing 11 and also to be spaced from the side walls thereof.

The housing 11 is provided with a plurality of spring clip arrangements 14, the distance between adjacent arrangements being variable by the provision of a plurality of receiving means 16 (see FIG. 1) into which a spring clip arrangement 14 may be located.

The housing 11 in the embodiment illustrated is formed of metal and a window arrangement 17 is provided in a wall portion of the housing 11 in the region in which the reservoir for the vaporisable antioxidant(s) or composition containing such antioxidant(s), is located, thereby enabling a ready check to be made as to the level of the vaporisable composition, in such reservoir.

In FIGS. 1 and 2, the vaporisable antioxidant composition is located in a reservoir in the form of a glass or plastics bottle 18 having a restricted opening and a vaporising wick 19 of suitable surface area is inserted into such opening and below the level of the composition within said bottle 18. The vaporising wick arrangement 19 is in the form of a suitable absorbent paper of fluted design.

In operation after one or more of the paint brushes 13 have been utilised, each brush is returned to the housing 11 by removing the cover 12 therefrom and inserting the neck of such paint brush(es) 13 into respective spring clip arrangements 14. The cover 12 is thereafter placed on top of the housing 11. By provision of the antioxidant composition within bottle 18 and the provision of a fluted wick arrangement 19, vaporisable antioxidant is provided within the housing 11 and prevents, or substantially prevents, hardening of the paint which is present on the bristles of each paint brush 13.

When a paint brush 13 is required for further use, the cover 12 is removed from housing 11 and the paint brush 13 is disengaged from the clip arrangement 14. The brush 13 is then suitable for such further use, the paint thereon not having hardened and the bristles being soft and pliable.

It would of course be possible for the reservoir arrangement 18 to be located outside the housing 11, suitably in a bottle clipped to the outside thereof with an aperture provided in the side wall to enable a wick arrangement to extend from the neck of the bottle and through such aperture into the interior of the housing 11.

Figure 4:
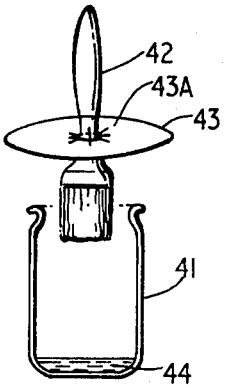
FIGS. 4, 5, 6, 7 and 8A and 8B show alternative forms of apparatus which may be utilised in accordance with the present invention.

In FIG. 4 there is illustrated one alternative form of apparatus in accordance with the invention. In this instance, the housing is constituted by a suitable glass or plastics jar 41 and the cover and means for suspending paint brush 42 is in the form of a disc 43.

The vaporisable antioxidant composition is simply poured into the bottom of the jar 41 as shown at 44. The handle of the paint brush 42 can be removed from the combined cover and suspension means by provision of the various cuts 43A in the disc 43.

Figure 5:
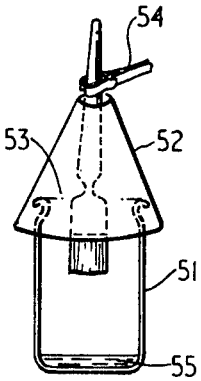

In FIG. 5, a further arrangement is illustrated wherein the housing is again constituted by a glass or plastics jar 51. The cover in this instance is in the form of a cone 52 of suitable material so as to be rigidly located over the top of the jar 51. An aperture is provided in the top of the cone 52 through which can be inserted the handle of a paint brush 53. The paint brush 53 is suspended in position by use of a suitable securing means e.g. a peg 54. The vaporisable antioxidant composition is again poured into the base of the jar 51 as shown at 55.

Figure 6:
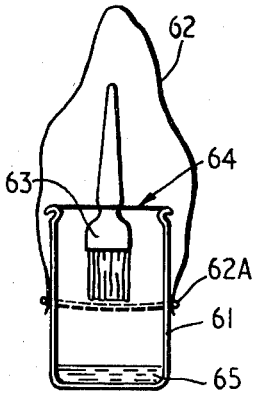

FIG. 6 shows a further alternative apparatus in accordance with the invention and in this case the housing is again constituted by a glass or plastics jar 61. A cover for such jar 61 is in the form of a polythene bag 62, the open end 62A of which is securable around the walls of the jar 61. The paint brush 63 is suspended in the jar 61 by the provision of a wire support frame 64. The vaporisable antioxidant composition is again poured into the base of the jar 61 as shown at 65.

Figure 7:
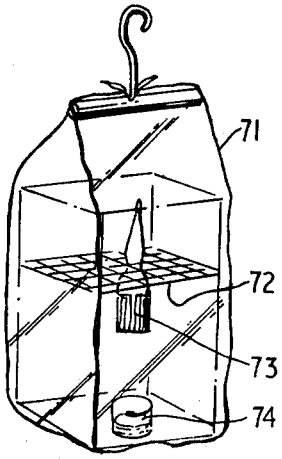

FIG. 7 shows a still further embodiment of the present invention in which both the housing and cover therefor is constituted by a polythene bag 71. Within such bag 71 there is provided a wire frame 72, forming a framework for the polythene bag 71 and forming the suspension means for the paint brush 73. In this case the vaporisable antioxidant composition is provided in a container 74 which is located on the ground surface within the area covered by the polythene bag.

Figure 8A:
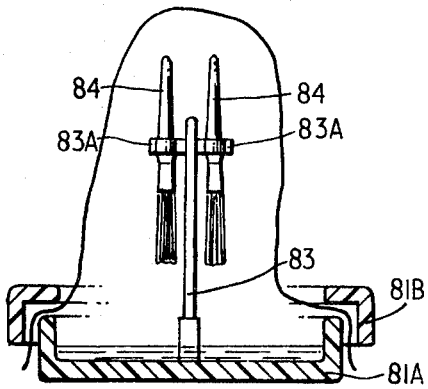
Figure 8B:
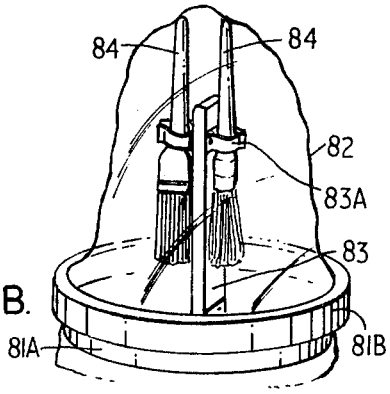

FIGS. 8A and 8B illustrate a still further embodiment in accordance with the present invention whereby in this case the housing is in the form of a two part arrangement 81A and 81B. The cover is in the form of a polythene bag 82, the free end of which is insertable between the housing members 81A and 81B and secured in place by pressing member 81B onto 81A. The suspension means in this case comprises a fixed member 83 which is firmly fixed to the base of the housing member 81A. Additional clip arrangement 83A is provided into which the neck of paint brushes 84 are inserted. The vaporisable antioxidant composition is located in the base of the member 81A.

It will thus be seen that many alternatives are possible within the scope of the present invention for either suspending the brushes within the housing and also for providing the vapour system within such housing.

The invention will be further explained, in a non-limiting manner, with reference to the following example.

EXAMPLE

A housing in accordance with FIGS. 1 and 2 having a volume of 5000 cc, was provided with a 60 ml. bottle of the particularly preferred composition. A fluted absorbent paper wick was inserted in the bottle leaving an exposed area of approximately 100 sq. cm. The cover, which was not an airtight fit, was replaced on the housing for a period of 2 hours to allow the composition to vaporise from the wick and form sufficient vapour concentration within the housing. Four 1-inch brushes were each dipped into and permeated with a different paint, namely:

Dulux (Registered Trade Mark) Brilliant White Gloss,

Crown Plus 2 Brilliant White Gloss, non-drip Polyurethane,

Valspar (Registered Trade Mark) Gloss Gardenia,

Blackfriars Black Blackboard Paint, each being inserted into the housing and the cover replaced.

The brushes were examined on numerous occasions over a period of four months and were found at all times to be in a completely soft, wet and usable condition. It was noted that a small amount of each paint except Blackfriars had dripped onto the base of the housing.

Approximately 30 ml of the composition had been used.

We claim:

1. An apparatus for the at least substantial prevention of hardening of paint brushes and related items for paints, varnishes, sealers, coatings, and the like that harden by an oxidation/polymerization mechanism, comprising a housing for said paint brushes and related items, means for suspending one or more of said brushes and related items or paint applying portions thereof within said housing, a cover for said housing, and means providing one or more antioxidants in said housing to provide a vapor system that at least substantially prevents the stated hardening of the paint by an oxidation/polymerization mechanism on said paint brushes and related items, or paint applying portions thereof when suspended within said housing.

2. An apparatus as claimed in claim 1, wherein, when utilizing paint brushes, the suspension means comprises appropriate plastics material means.

3. An apparatus as claimed in claim 1, wherein, when utilizing paint brushes, the suspension means comprises suitable magnetic devices.

4. An apparatus as claimed in claim 1, wherein, when utilising paint brushes, the suspension means comprises one or more spring clip arrangements into which, in use, the neck of a brush can be placed and a flange extends from the side wall of the housing, against which flange the metal ferrule portion of the brush can contact.

5. An apparatus as recited in claim 4, wherein the vaporisable antioxidant(s) or composition containing such antioxidant(s) is provided in a suitable container having means to ensure an adequate vaporising area to be established within the housing in which the paint brushes and related items are suspended.

6. An apparatus as recited in claim 5, wherein said antioxidant(s) or composition containing such antioxidant(s) is provided in a container having a restricted opening and a vaporising wick of suitable surface area being inserted therein.

* * * * *

UNITED STATES PATENT AND TRADEMARK OFFICE

CERTIFICATE OF CORRECTION

PATENT NO. : 4,388,767

DATED : June 21, 1983

INVENTOR(S) : DISON, et al

It is certified that error appears in the above-identified patent and that said Letters Patent is hereby corrected as shown below:

Column 1, Line 17, the word "immersion" should be "immersing".

Column 2, Line 9, correct spelling of "chemicals".

Column 2, Line 22, delete the word "a".

Column 7, Line 10, change "claim 4", should read "claim 1".

Signed and Sealed this

Tenth Day of April 1984

[SEAL]

*Attest:*

GERALD J. MOSSINGHOFF

*Attesting Officer*

*Commissioner of Patents and Trademarks*